US005716101A

United States Patent [19]

Frinier et al.

[11] Patent Number: 5,716,101

[45] Date of Patent: Feb. 10, 1998

[54] SEAT RAIL ATTACHMENT DEVICE

[75] Inventors: Richard D. Frinier, Long Beach; Oliver Wang, Millbrae, both of Calif.

[73] Assignee: BJIP, Inc., Los Angeles, Calif.

[21] Appl. No.: 679,000

[22] Filed: Jul. 12, 1996

[51] Int. Cl.[6] ..... A47C 7/02

[52] U.S. Cl. ..... 297/440.22; 297/452.13; 297/440.11; 297/218.4

[58] Field of Search ..... 297/440.11, 440.22, 297/452.13, 452.63, 218.4; 160/392, 395, 383, 327, 398

[56] References Cited

U.S. PATENT DOCUMENTS

| | | | |
|---|---|---|---|
| 2,856,990 | 10/1958 | Thomas | 160/327 |
| 3,175,269 | 3/1965 | Raduns et al. | 160/383 |
| 3,248,150 | 4/1966 | Lilienfeld | 297/440.11 |
| 4,105,244 | 8/1978 | Colby | 297/440.11 X |
| 4,872,724 | 10/1989 | Deley et al. | 297/218.4 |
| 5,338,091 | 8/1994 | Miller | 297/218.4 |
| 5,507,563 | 4/1996 | Arthur, Jr. | 297/452.13 X |
| 5,540,476 | 7/1996 | Cowsert | 160/392 X |

*Primary Examiner*—Peter M. Cuomo
*Assistant Examiner*—Stephen Vu
*Attorney, Agent, or Firm*—Christie, Parker & Hale, LLP

[57] ABSTRACT

An outdoor patio chair comprising a metal frame structure of three dimensional shape including at least a back section and a seat section. The chair further includes first and second seat rails for supporting a fabric seat panel and a hardwareless attachment mechanism for releasably securing a front section of the seat rails to the seat section of the frame structure. The attachment mechanism includes a pin which is positioned in an opening in the seat rail and is supported above the seat section by a support post and a stiffener. Tension in the fabric seat panel maintains the pins to the seat rails.

3 Claims, 2 Drawing Sheets

SEAT RAIL ATTACHMENT DEVICE

FIELD OF THE INVENTION

This invention relates generally to outdoor patio furniture, and more particularly, to a hardwareless attachment device for securing the front portion of a seat rail to the chair frame.

BACKGROUND OF THE INVENTION

Outdoor patio manufacturers are constantly seeking to develop new product designs and new ideas for reducing manufacturing costs and assembly time. The more traditional patio furniture is massed produced in many attractive and distinctive designs and color combinations. Typical of these designs are the casual outdoor furniture products made from welded tubular aluminum, steel, or other metal framing with a powder coat finish.

A problem with metal outdoor patio furniture is that it can be uncomfortable to be seated on for an extended period of time, unless the seating surfaces are designed properly. Typically, when people are using patio furniture it is during a time of leisure and therefore a comfortable seating surface is desirable.

Manufacturers of outdoor furniture have designed the furniture to incorporate cushions to make the furniture more comfortable. However, cushions can be inconvenient because they must be stored indoors to protect them from the elements such as rain and prolonged sun exposure. Not only is it inconvenient to remove the cushions after each use, but the cushions themselves can require additional storage space when not in use.

Recognizing the problems associated with metal outdoor patio furniture and the problems created by the use of cushions, manufacturers have looked for a way to upholster patio chairs with a material that is comfortable yet will not require its removal and storage when not in use. It became apparent that a woven vinyl coated polyester fabric was an ideal material for use with outdoor patio furniture. This material possesses qualities of providing a comfortable seating surface while being water resistant and therefore able to withstand an outdoor environment.

A problem faced by manufacturers of outdoor patio furniture is how to attach the nylon fabric to a metal frame structure. The material has to be secured to the frame in such a way that it provides a seating and back surface strong enough to support the user while providing a comfortable surface. Use of fasteners such as staples or rivets was not desirable or practical for certain metal frame outdoor furniture.

The patio furniture industry has in recent years used a method for attaching woven vinyl coated polyester fabric to a metal frame structure which has proved to be highly successful. This technique includes the step of folding over the edges of the fabric and stitching the edge down to form a loop along opposite edges of the fabric. These loops are then attached to a seat rail by inserting them in a groove along the surface of the hollow seat rail, such that the loop extends through the center of a hollow channel in the seat rail. A flexible plastic rod having a diameter larger than the width of the groove is threaded through the channel in the loop within the seat rail, thereby securing the fabric to the seat rail along its entire length. The chair rails are then bolted to the chair frame by suitable hardware passing through the seat rail and into the chair frame along three points, being the top, middle and front of the seat rail. This standard attachment method for securing the seat rail to the chair frame increases production costs by requiring threaded holes to be located in the chair frame as well as reinforced locations to withstand the stresses concentrated at the connection points between the seat rail and the chair frame. This attachment mechanism also increased assembly time for installing the attachment hardware i.e., nuts and bolts. Consequently, there exists a need for a design and method for attaching the seat rail to the chair frame which is less expensive, easier to manufacture, reduces the amount of attachment hardware, and increases the speed of assembling the finished product.

SUMMARY OF THE INVENTION

The present invention provides an upholstered outdoor patio chair having a hardwareless means for attaching the front of the seat rail to the seat frame, and a method for easily assembling the seat rail to the chair frame.

In one embodiment, the chair comprises a rigid metal frame structure in which frame members are preferably made of extruded metal having a cross-section which includes one or more internal cavities extending lengthwise along the frame member. The frame members are assembled in a desired design configuration to form a frame structure defining the contours of a right and left sides and a back surface of the chair. The chair frame comprises elongated continuous support members defining the legs, back, and arm rests of the chair. The chair further includes a generally L-shaped seat rail having a groove in an upper surface which extends into a hollow interior of the composite cross-sectional structure of the seat rail. This groove is used to attached woven nylon fabric to the seat rail.

A separate seat rail is utilized for each side of the chair and a fabric panel is cut to fit in between the two seat rails. An elongated narrow flexible loop is formed along marginal edges of the panel, which are placed through the grooves in the seat rails. Flexible plastic rods having diameters greater than the width of the groove in the frame are then threaded through the loops in the fabric inside the hollow section of the seat rail to maintain the fabric panel in place.

Each seat rail is attached to the chair frame at three points along the length of the seat rail. The seat rail is attached to the chair frame at the top of the back portion by a screw or bolt passing through the seat rail and into the chair frame. Likewise, the juncture of the seat portion and back portion (the middle) of the seat rail is joined to the chair frame by a threaded screw or bolt passing through the chair rail and into the seat frame. The front of the seat rail, to which the invention is directed, is attached to the chair frame by a hardwareless attachment means. The attachment means comprises a pin extending perpendicularly to the seat rail above the seat frame by a support post extending perpendicularly upward from and welded to the seat frame. The hardwareless attachment means also includes a stiffener extending downwardly from the pin at an angle towards the chair frame where it is welded thereto. The front chair rail attachment means is an integral component consisting of the pin, support post and stiffener. A hole is drilled on the inside surface of the seat rail for receipt of the pin. The front of the seat rail is consequently connected to the chair frame by inserting the pin into the hole in the seat rail on both sides of the chair. The tension in the nylon seat panel maintains the pin within the hole.

Another advantage created by the attachment means is that it creates a gap between the armrest and the fabric panel seating surface allowing multiple chairs to be stacked upon each other for storage. The gap provides room for the legs of the next chair in the stack.

These and other aspects of the invention will be more fully understood by referring to the following detailed description and the accompanied drawings.

DETAILED DESCRIPTION

Figure 1:
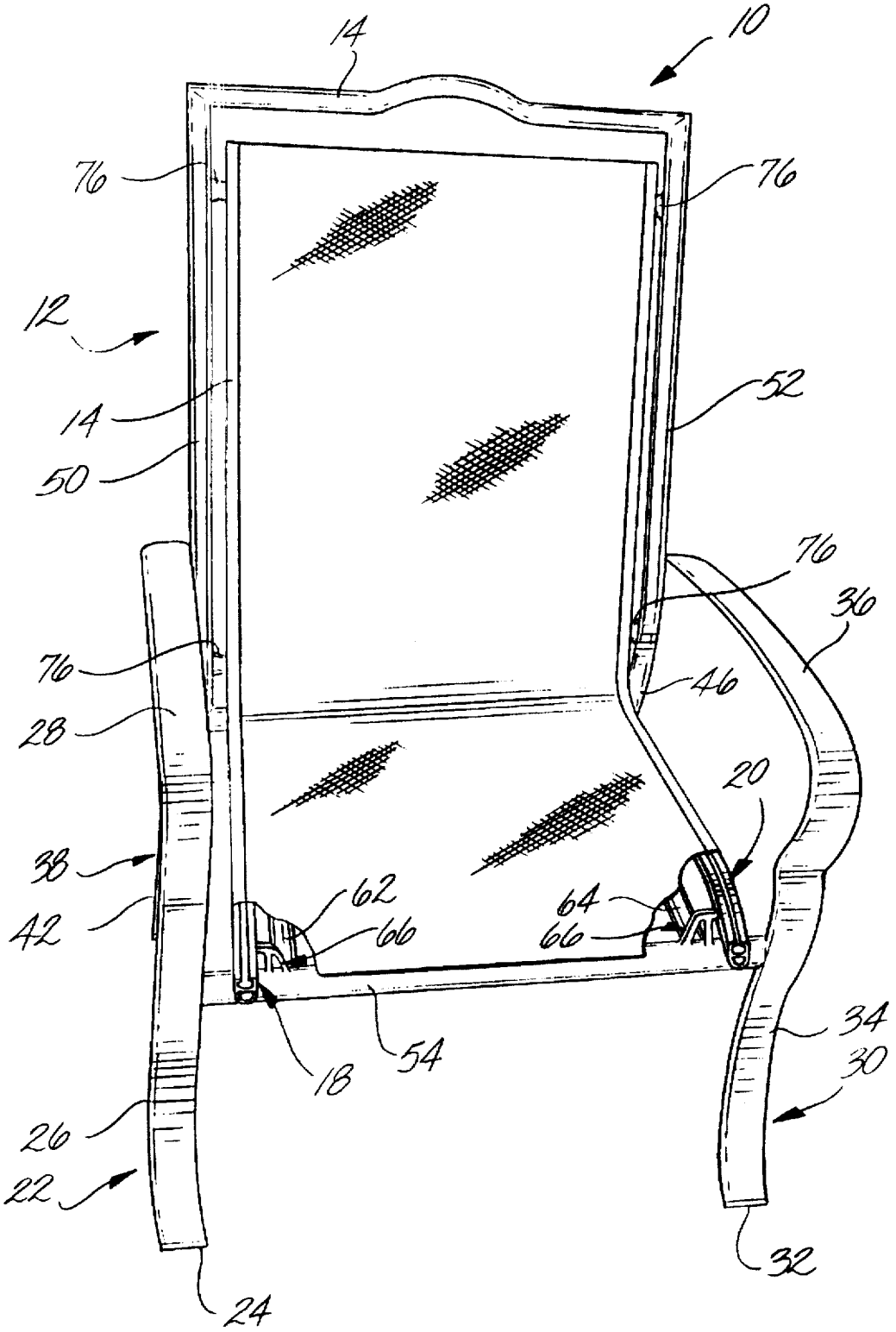
FIG. 1 is a front perspective view, partially broken away, illustrating the front seat rail attachment means.

Referring to the drawings, FIG. 1 illustrates an upholstered outdoor patio chair 10 constructed in accordance with the principles of this invention. The chair consists of a metal chair frame structure 12 to which right and left seat rails 14 and 16 respectfully, are attached. More specifically the invention is directed to the method of attaching the front portions 18 and 20 of the seat rails to the metal frame structure 12.

The chair frame structure comprises a plurality of sections. A first frame member 22 begins at a first ground engaging end 24 and extends vertically to form the left front leg 26 of the chair. The first frame section continues, then having a first bend and extends rearwardly at an angle forming the left arm rest 28. A second frame member 30 begins at a second ground engaging end 32 and extends vertically to form the right front leg 34 of the chair. The second frame section continues, then having a first bend and extends rearwardly at an angle forming the right arm rest 36. A third frame section 38 begins at a third ground engaging end 40 and extends vertically forming the left rear leg 42 of the chair. The third frame section continues, then having a first bend and extends horizontally at an angle forming the back rest 44 before having a second bend and extending downwardly to form the right rear leg 46. The third frame member terminates at a fourth ground engaging end 48. The left arm rest 28 and the right arm rest 36 terminate and are welded to the left rear leg 42 and right rear leg 46 at points 50 and 52 respectively.

Metal frame structure 12 further includes a front horizontal support member 54, welded between the left and right front legs, and a rear horizontal support member 56 welded between the left and right rear legs, for added structural rigidity. Horizontal support members 54 and 56 are welded in the general location of the seating surface 58. The seating surface 58 and a back surface 60 are formed by a panel of woven vinyl coated polyester material extending under tension between the left and right seat rails. The chair frame structure 12 also includes lateral support members 62 and 64 welded between horizontal support members 54 and 56 and are positioned below seating surface 58. It is to be understood that although metal frame structure 12 has been described with respect to specific frame members forming the legs, back portion and arm rest portion of the chair, the invention is equally applicable to other chair frame designs utilizing other frame member segments to form the legs, back and arm rest of the chair frame. The metal frame structure preferably is made of an extruded aluminum, however other types of metal or plastics can be utilized for the present invention.

Figure 2:
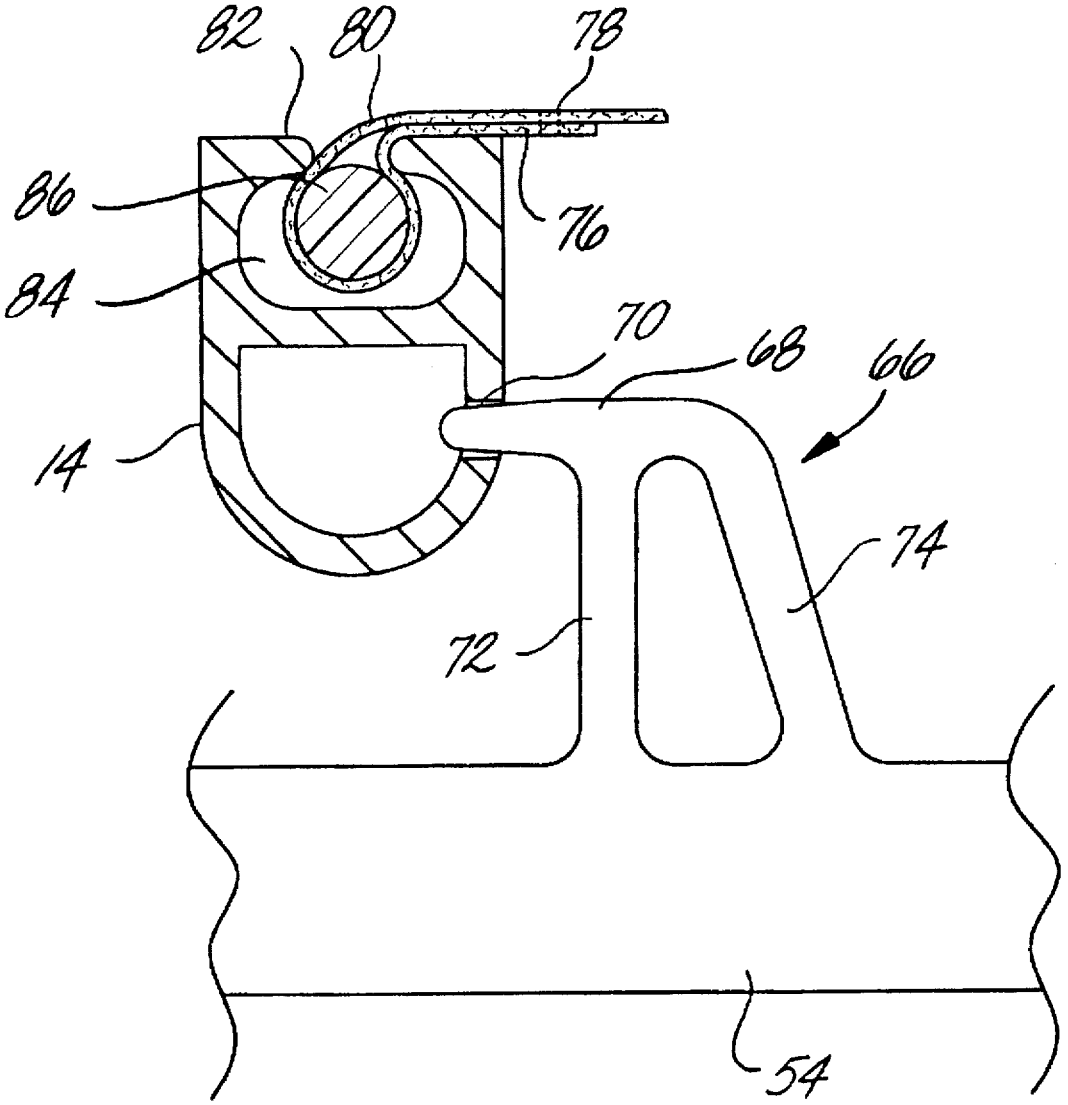
FIG. 2 is an enlarged detail of the front seat rail attachment means of FIG. 1.

As seen best in FIG. 2 the front portions 18 and 20 of the seat rails 14 & 16 are rigidly attached to the metal frame structure 12 by a hardwareless attachment means 66. Attachment means 66 includes a pin 68 which extends into a hole 70 drilled through the side of the seat rail. The attachment means 66 further includes a vertical support post 72 and a stiffener 74 welded at an angle between the pin and the front horizontal support member 54. As seen in FIG. 1 the top and middle sections of the left and right seat rails are attached to the metal frame structure by standard hardware 76 such as a bolt or a screw which passes through the seat rails and into a reinforced portion of the metal frame structure. The metal frame can be either threaded for receipt of the hardware, or alternatively it can be drilled with holes for the attachment of a nut to the hardware.

Attachment means 66 eliminates previously used hardware and decreases assembly time and lowers the overall costs of the patio chair thereby reducing labor costs and material costs. The chair is assembled by simply bolting the upper and middle portions of the seat rails to the chair frame and then installing the woven fabric material in the seat rails. The fabric material is installed by folding over the lateral edges 76 and stitching 78 to form an elongated loop along the edge of the seat panel. FIG. 2 illustrates a loop 80 formed by stitching 78. Loop 80 is then inserted into the seat rail through a groove 82 and into a hollow channel 84 in the seat rail. A flexible plastic rod 86 having a diameter larger than the width of the groove is threaded through the channel and the loop within the frame, thereby securing the fabric to the seat frame members along its entire length. When the plastic rod is inserted the front portions of the seat rails are not engaged with the attachment means 66 thereby providing sufficient slack for the insertion of the fabric panel to the seat rail. Once the fabric panels are fully inserted into the seat rails, the pin 68 is inserted in hole 70 in the seat rails thereby rigidly attaching the seat rail front portion to the chair frame. The tension in the fabric rigidly connects the seat rail front portion to the chair frame.

Although the present invention is illustrated with respect to a preferred embodiment and alternative thereof, it is to be understood that it is not to so limited, since changes and modifications may be made therein which are within the full intended scope of this invention as hereinafter claimed.

What is claimed is:

1. An outdoor patio chair comprising:

a metal frame structure of three dimensional shape including at least a back section and a seat section;

first and second rails for supporting a fabric seat panel, the first and second seat rails are rigidly attached to the seat back section of the frame structure; and a pair of outwardly extending pins laterally spaced above the chair from the seat section by support posts extending upwardly from the seat section, said pins engaging holes in the seat rails for releasably securing the seat rails to the seat section of the frame structure such that tension in the fabric seat panel maintains the pins within the holes in the seat rails.

2. The chair of claim 1 wherein each pin further includes a stiffener positioned at an angle between the pin and the seat section.

3. The chair of claim 2 wherein the pin, support post and stiffener are integral with the seat section.

* * * * *